US006504314B1

(12) United States Patent
Gradzki et al.

(10) Patent No.: US 6,504,314 B1
(45) **Date of Patent: *Jan. 7, 2003**

(54) DISCHARGE LAMP DC BALLAST EMPLOYING ONLY PASSIVE COMPONENTS

(75) Inventors: Pawel M. Gradzki, Potomac, MD (US); Ulrich Böke, Geilenkirchen (DE); Hubert Raets, Landgraaf (NL); Johannes A. A. Wijntjes, Waalre (NL)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/967,680

(22) Filed: Nov. 10, 1997

(51) Int. Cl.[7] ..... H05B 37/02
(52) U.S. Cl. ..... 315/224; 315/209 R
(58) Field of Search ..... 315/205, 311, 315/58, 209 R, 200 R, DIG. 5, 240, 94, 106, 107, 173, 291, 224, 225, 307, 219

(56) References Cited

U.S. PATENT DOCUMENTS

| | | | | |
|---|---|---|---|---|
| 4,001,637 A | * | 1/1977 | Gray | 315/205 |
| 4,045,710 A | | 8/1977 | Neal | 315/205 |
| 4,187,449 A | | 2/1980 | Knoble | 315/205 |
| 4,260,932 A | * | 4/1981 | Johnson | 315/205 |
| 4,274,029 A | | 6/1981 | Buxbaum | 313/204 |
| 4,929,871 A | | 5/1990 | Gerfast | 315/205 |
| 5,164,635 A | * | 11/1992 | De Jong et al. | 315/58 |
| 5,726,537 A | * | 3/1998 | Huber et al. | 315/311 |
| 5,744,915 A | * | 4/1998 | Nilssen | 315/209 R |

FOREIGN PATENT DOCUMENTS

EP 0604221 A1 6/1994

OTHER PUBLICATIONS

Willard Allphin, "Primer of Lamps and Lighting", Published in Philadelphia by Chilton Company, pp. 67–96, 1959.*
Allphin "Primer of Lamps and Lighting" [1959], Figure 68.*
Singer, Basic mathematics for electricity and electronics, 1995 glencoe/McGraw–Hill, 7th edition.*

* cited by examiner

*Primary Examiner*—Don Wong
*Assistant Examiner*—Wilson Lee
(74) *Attorney, Agent, or Firm*—Dicran Halajian

(57) ABSTRACT

A circuit arrangement for supplying a lamp with a DC lamp current and comprising only passive components and equipped with mains input terminals for connection to the poles of an AC supply voltage source. A rectifying apparatus has two input terminals coupled to the mains input terminals and two output terminals for generating a DC voltage from the low frequency AC supply voltage. A ballast capacitor is coupled between the mains input terminals and the output terminals of the rectifying apparatus. A load circuit is coupled to the output terminals of the rectifying apparatus and has terminals for connection to the lamp. The load circuit includes a series arrangement of only passive components which connect the output terminals of the rectifying apparatus and comprise an inductor and the terminals for connection to the lamp. The circuit arrangement is simple and inexpensive and is very suitable for operating a discharge lamp and for incorporation into a compact lamp.

22 Claims, 3 Drawing Sheets

DISCHARGE LAMP DC BALLAST EMPLOYING ONLY PASSIVE COMPONENTS

BACKGROUND OF THE INVENTION

This invention relates to a circuit arrangement for supplying a lamp with a DC lamp current comprising only passive components and equipped with

- mains input terminals for connection to poles of a supply voltage source,
- rectifying means, equipped with two input terminals, coupled to the mains input terminals, and two output terminals, for generating a DC voltage out of a low frequency AC voltage supplied by said supply voltage source,
- capacitive means, coupled between the mains input terminals and the output terminals of the rectifying means,
- a load circuit coupled to the output terminals of the rectifying means and comprising terminals for connection to the lamp, and
- inductive means.

The invention also relates to a compact lamp.

A circuit arrangement as mentioned in the opening paragraph is known from U.S. Pat. No. 4,929,871. In the known circuit arrangement the inductive means and the capacitive means are arranged in series between one of the mains input terminals and one of the input terminals of the rectifying means that are formed by a diode bridge. The load circuit contains only the terminals for lamp connection. During operation the known circuit arrangement supplies a DC current to the load. The known circuit arrangement is relatively simple and therefore relatively cheap. An important disadvantage of the known circuit arrangement, however, is that during stationary operation the lamp current becomes zero in every half period of the low frequency AC voltage. As a result the lamp will extinguish in every half period of the low frequency supply voltage. In case the lamp is a discharge lamp, it will therefore have to be reignited in each half period of the low frequency supply voltage. This reduces the life of the lamp electrodes and also causes reignition losses.

The invention aims to provide a circuit arrangement for operating a discharge lamp (low pressure or high pressure) that is relatively cheap and simple and does not have the disadvantages mentioned hereabove.

SUMMARY OF THE INVENTION

A circuit arrangement as mentioned in the opening paragraph is therefore, in accordance with the invention, characterized in that the load circuit is equipped with a series arrangement connecting the output terminals of the rectifying means and comprising the inductive means and the terminals for connection to the lamp.

Since the inductive means are in series with the lamp during lamp operation, the inductive means supplies the lamp with a "keep-alive current" when the voltage between the input terminals of the rectifying means is close to zero Volt. This "keep-alive current" flows from a first terminal of the inductive means through the rectifying means and the lamp to a second terminal of the inductive means. The operation is called continuous operation, if the circuit arrangement is so dimensioned that the lamp current never drops to zero. Therefore, in case of continuous operation and in case the lamp is a discharge lamp, the lamp does not extinguish and need not be reignited every half period of the supply voltage. It should be mentioned that the circuit can also be so dimensionedntat so the keep alive current becomes zero in the time lapse during which the voltage between the input terminals of the rectifying means is close to zero. This is called discontinuous operation. The lamp, if it is a discharge lamp, will extinguish and will have to be reignited every half period of the supply voltage. It has been found both for continuous as well as for discontinuous operation that the inductance of the inductive means and the capacitance of the capacitive means in a circuit arrangement according to the invention can be chosen considerably smaller than in the circuit arrangement disclosed in U.S. Pat. No. 4,929,871. The circuit arrangement according to the invention can therefore be considerably less voluminous and weigh substantially less than the known circuit arrangement. Another important advantage over the prior art that was found to exist for continuous operation only is a fast ignition of the discharge lamp without "pinking" and with only relatively little sputtering of emitter material from the electrode taking place. Since the inductive means are only subjected to a DC current, the flux swing and the core losses in the inductive means are relatively small resulting in an efficient operation of the circuit arrangement.

Preferably, the impedance of the capacitive means is higher than the impedance of the inductive means. The capacitive means functions as a current limiter, while the inductive means supplies current to the lamp during at least part of the time lapse during which current is not supplied to the lamp by the supply voltage source.

Since, as explained hereabove, the inductance of the inductive means can be relatively small, the inductive means may comprise a choke with a core of compressed iron powder. The inductive means can thus be realized in a relatively cheap and simple way and the core can easily be manufactured in many different forms. This latter aspect can be very important in the case where the circuit arrangement is integrated in a compact lamp, since it is possible to choose a form of the core, such as for instance a toroid, that will easily fit into the compact lamp and provides good heat conduction from the circuit arrangement into the environment.

The rectifying means may comprise a diode bridge but alternatively the rectifying means may comprise a voltage doubler. This is particularly usefull in case the amplitude of the low frequency supply voltage is relatively low. In case the capacitive means is formed by two capacitors comprised in the voltage doubler, these two capacitors function both as current limiter and as part of the voltage doubler, so that different functions in the circuit arrangement are realized using relatively few components. The rectifying means can also comprise both a diode bridge and a voltage doubler, the voltage doubler comprising two of the diodes of the diode bridge and two capacitors. The rectifying means substantially function as a voltage doubler at low loads, i.e. before the lamp operated by means of the circuit arrangement has ignited. This way a high enough ignition voltage is realized, even in the case where the amplitude of the low frequency AC voltage supplied by the supply voltage source is relatively low. After ignition of the lamp, when the load has increased, the rectifying means substantially function as a diode bridge.

Good results have been obtained with relatively simple embodiments of the circuit arrangement according to the invention wherein the circuit arrangement exclusively comprises components that make up the capacitive means, the inductive means and the rectifying means.

Since it comprises relatively few components and is therefore relatively small, a circuit arrangement according to the invention is very suitable to be used in the ballast means of a compact lamp comprising a light source provided with a vessel that is closed in a gastight manner and transmissive for visible radiation, a housing connected to the light source and provided with a lamp cap, ballast means electrically connected to the light source for operating the light source and positioned at least partly in a space surrounded by the housing.

BRIEF DESCRIPTION OF THE DRAWINGS

Preferably the circuit arrangement is so dimensioned that the DC current that flows through the light source during operation of the compact lamp is continuous.

In case such a compact lamp is, for instance, a compact fluorescent lamp and the light source contains mercury, it is very advantageous if the light source comprises an amalgam. It has been,found that the amalgam compensates to a large extent the effect of cataphoresis, which takes place since the lamp,is supplied with a DC-current. Preferably the amalgam contains lead, bismuth and tin or bismuth and indium.

Embodiments of the invention will be described making use of a drawing. In the drawing.

DETAILED DESCRIPTION OF THE PREFERRED EMBODIMENTS

Figure 1:
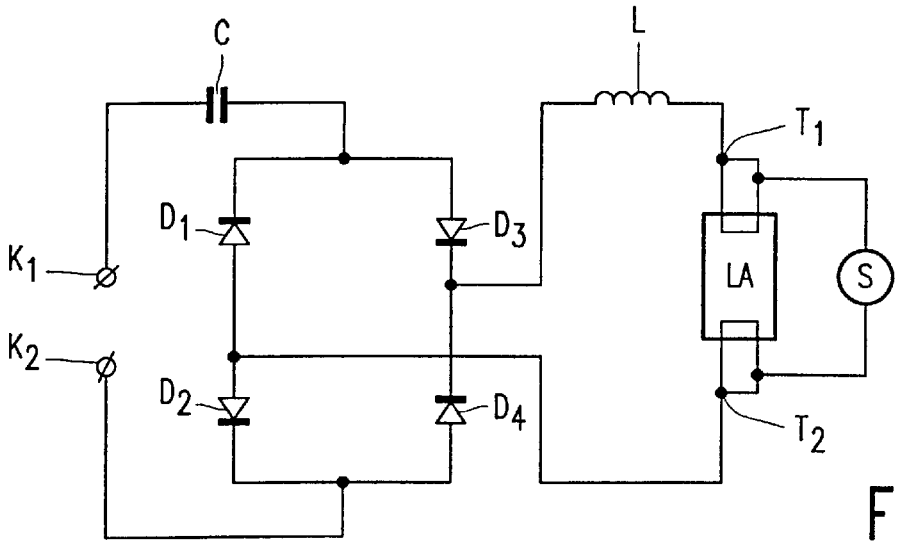
FIG. 1 shows a schematic representation of a first embodiment of a circuit arrangement according to the invention with a discharge lamp connected to it.

In FIG. 1 K1 and K2 are mains input terminals for connection to poles of a supply voltage source. Mains input terminal K1 is connected by means of a capacitor C to a first input terminal of a rectifying means that in this embodiment is formed by the diode bridge D1–D4. Capacitor C forms the current limiter capacitive ballast means in this embodiment. A second input terminal of the rectifying means is connected to mains input terminal K2. Output terminals of the rectifying means are connected by means of a series arrangement of choke L and terminals T1 and T2 for lamp connection. In the embodiment shown in FIG. 1 choke L forms the inductive means. A discharge lamp La is connected to terminals T1 and T2. The discharge lamp is shunted by a glow switch starter S. A filter capacitor is not connected to the output terminals of the rectifying means.

The operation of the circuit arrangement shown in FIG. 1 is as follows.

When the poles of a supply voltage source supplying a low frequency AC voltage are connected to the, mains input terminals K1 and K2, the low frequency AC voltage is rectified by the diode bridge and a DC voltage is present between terminal T1 and terminal T2 causing a DC current to flow through the glow switch starter in case the discharge lamp has not yet ignited. This DC current can be used to preheat the cathode of the lamp. It has been found, however, that this is not always necessary. When the glow switch starter interrupts the DC current flowing through it, the choke generates a relatively high DC voltage between terminals T1 and T2 causing a breakdown in the lamp. In case the circuit arrangement is dimensioned for continuous operation it is capable of supplying a relatively large current immediately after breakdown. As a result a vapour arc is generated which can be sustained long enough for a stable hot spot to form on the cathode. As a result no glow discharge occurs during the ignition of the discharge lamp and sputtering of lamp electrode material is consequently substantially avoided. For this reason the electrode life and therefore the lamp life are strongly increased with respect to a lamp that is ignited making use of an AC voltage. Once the discharge lamp is ignited, a DC current flows through both the lamp and choke L. This DC current can be described as the sum of a constant DC current and an AC current with a frequency that is twice the frequency of the low frequency AC voltage supplied by the supply voltage source. The dimensioning is such that the capacitor C functions as an impedance that limits the DC current. The choke L in this embodiment comprises a toroid of compressed iron powder. When the amplitude of the voltage between the input terminals of the diode bridge drops below the value that is necessary for the rectifying means to conduct a supply current from the supply voltage source to the lamp, the choke supplies a "keep-alive current" to the lamp. This "keep-alive current" flows from one end of the choke L through the lamp and all four diodes back to the other end of choke L. Choke L is preferably so dimensioned that the "keep-alive current" does not drop to zero in the time lapse during which the rectifying means are not conducting a supply current. Alternatively, choke L can be so dimensioned that the "keep-alive current" does become zero only for a very short time in the time lapse during which the rectifying means are not conducting a supply current. In this latter case the lamp will easily reignite once the rectifying means are conducting the supply current again. In a practical realization of the embodiment shown in FIG. 1, the capacitance of capacitor C was chosen at 2.2 $\mu$F and the inductance of choke L at 1.6 H. The supply voltage source supplied a sinusoidal AC voltage with a frequency of 50 Hz and an amplitude of 220 Volts rms. It was found that the circuit arrangement was very suitable for operating a low pressure mercury discharge lamp with a nominal power of 18 Watt and a burner voltage of approximately 80 Volt.

Figure 5:
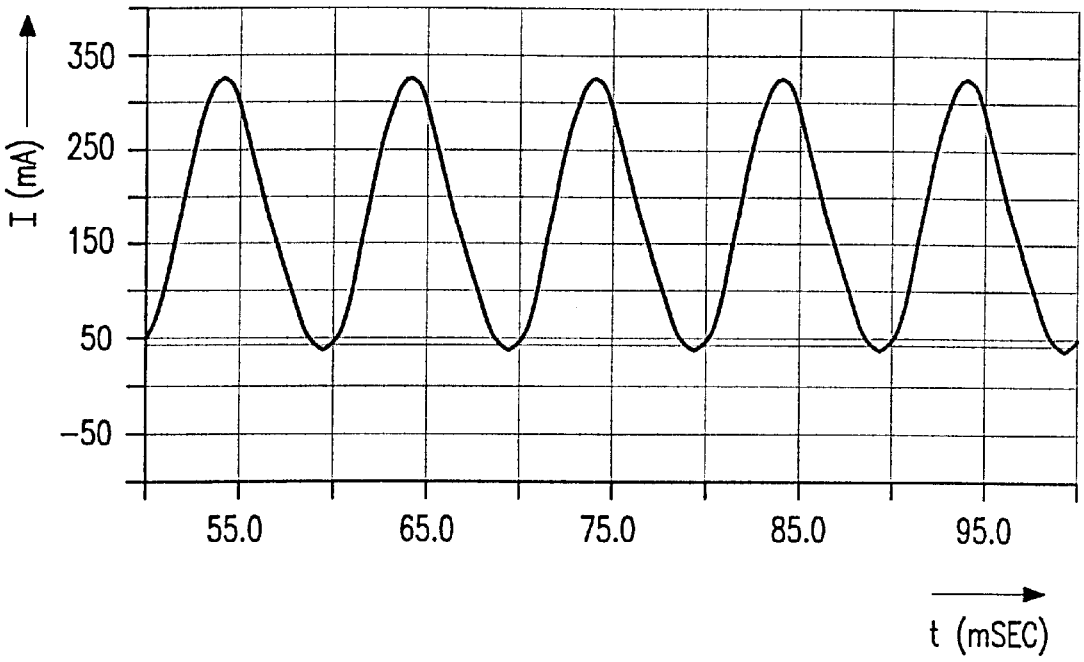
FIG. 5 shows the lamp current as a function of time for a discharge lamp operated by means of a circuit arrangement as shown in FIG. 1.

The shape of the lamp current of a low pressure mercury discharge lamp operated by a circuit arrangement as shown in FIG. 1 is shown in FIG. 5. Along the vertical axis current is plotted in mA and along the horizontal axis time is plotted in msec. It can be seen that the current is the sum of a constant DC current and an AC current with a frequency that is twice the frequency of the low frequency AC voltage supplied by the supply voltage source. The constant DC current (=the keep alive current) has an amplitude that is equal to the lowest value of the amplitude of the total lamp current. This amplitude is shown in FIG. 5 as a horizontal line. Since the frequency of the supply voltage that was used was 50 Hz, the frequency of the AC current part of the lamp current is 100 Hz.

Figure 2:
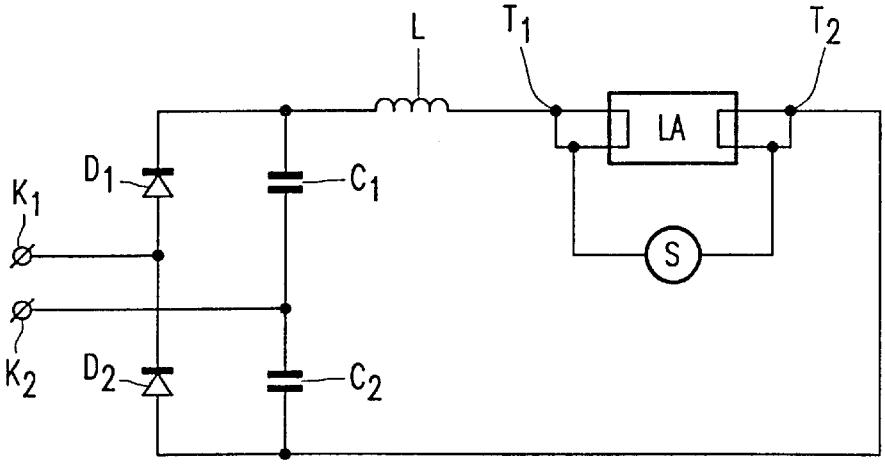
FIG. 2 shows a schematic representation of a second embodiment of a circuit arrangement according to the invention with a discharge lamp connected to it.

In FIG. 2 circuit parts that are similar to circuit parts in the embodiment shown in FIG. 1 are labelled with the same symbols. The rectifying means in this embodiment are formed by a voltage doubler consisting of capacitors C1 and C2 and diodes D1 and D2. The capacitors C1 and C2 are also the capacitive ballast means in this embodiment. The voltage doubler comprises a first series arrangement of capacitors C1 and C2. This first series arrangement is shunted by a second series arrangement of diodes D1 and D2 and by a third series arrangement of a choke L and lamp connection terminals T1 and T2. A discharge lamp La shunted by a glow switch starter S is connected to the terminals T1 and T2. Mains input terminal K1 is connected to a common terminal of diodes D1 and D2. Mains input terminal K2 is connected to a common terminal of capacitors C1 and C2. The maximum output voltage of the rectifying means in this embodiment (being the voltage over the series arrangement of capacitors C1 and C2) is equal to twice the maximum amplitude of the low frequency supply voltage. In the embodiment shown in FIG. 1 the maximum output voltage of the rectifying means only equals the maximum amplitude of the low frequency supply voltage. The embodiment shown in FIG. 2 can offer advantages in case the maximum amplitude of the low frequency supply voltage is relatively low. Otherwised the functioning of the embodiment shown in FIG. 2 is similar to that of the embodiment shown in FIG. 1 and will not be described here in detail. In a practical realization of the embodiment shown in FIG. 2, the capacitance of capacitors C1 and C2 was chosen at 3.9 $\mu$F and the inductance of choke L at 850 mH. The amplitude of the sinusoidal low frequency supply voltage that was used to supply the circuit arrangement was 120 Volt rms and its frequency was 60 Hz. It was found that the circuit arrangement was very suitable for operating a low pressure mercury discharge lamp with a nominal power of 18 Watt and a burner voltage of approximately 80 Volt.

Figure 3:
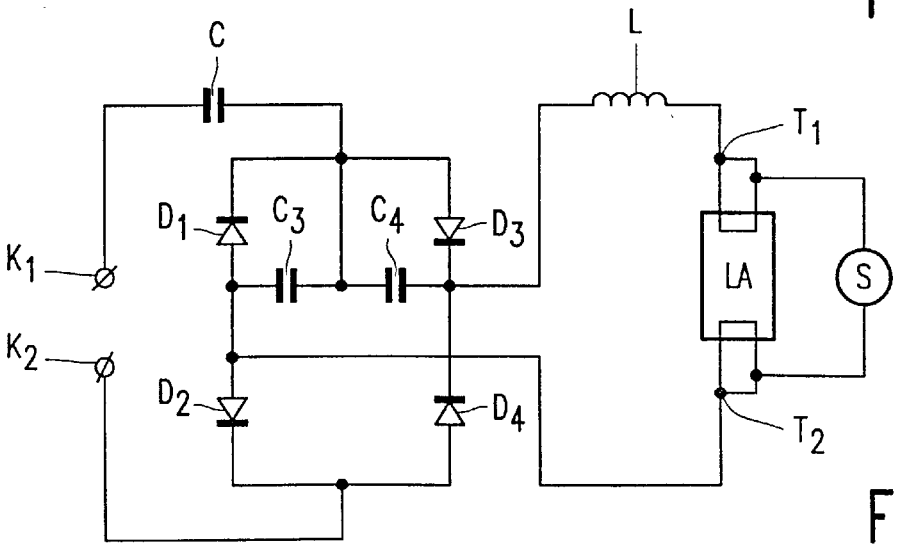
FIG. 3 shows a schematic representation of a third embodiment of a circuit arrangement according to the invention with a discharge lamp connected to it.

In FIG. 3 circuit parts that are similar to circuit parts in the embodiment shown in FIG. 1 are labelled with the same symbols. The rectifying means in this embodiment comprise both a diode bridge formed by diodes D1–D4 and a voltage doubler consisting of capacitors C3 and C4 and diodes D2 and D4. Capacitors C3 and C4 shunt diode D1 and diode D3 respectively. Apart from the presence of capacitors C3 and C4, the embodiment shown in FIG. 3 is similar to the embodiment shown in FIG. 1. The capacitances of capacitors C3 and C4 are chosen substantially equal and much smaller than the capacitance of ballast capacitor C. Before ignition, when the load of the circuit arrangement is very small the rectifying means substantially function as a voltage doubler so that the voltage across the lamp La is high enough to operate the starter S and ignite the lamp La. After ignition the rectifying means substantially function as a diode bridge and the functioning of the embodiment shown in FIG. 3 is the same as the functioning of the embodiment shown in FIG. 1.

Figure 4:
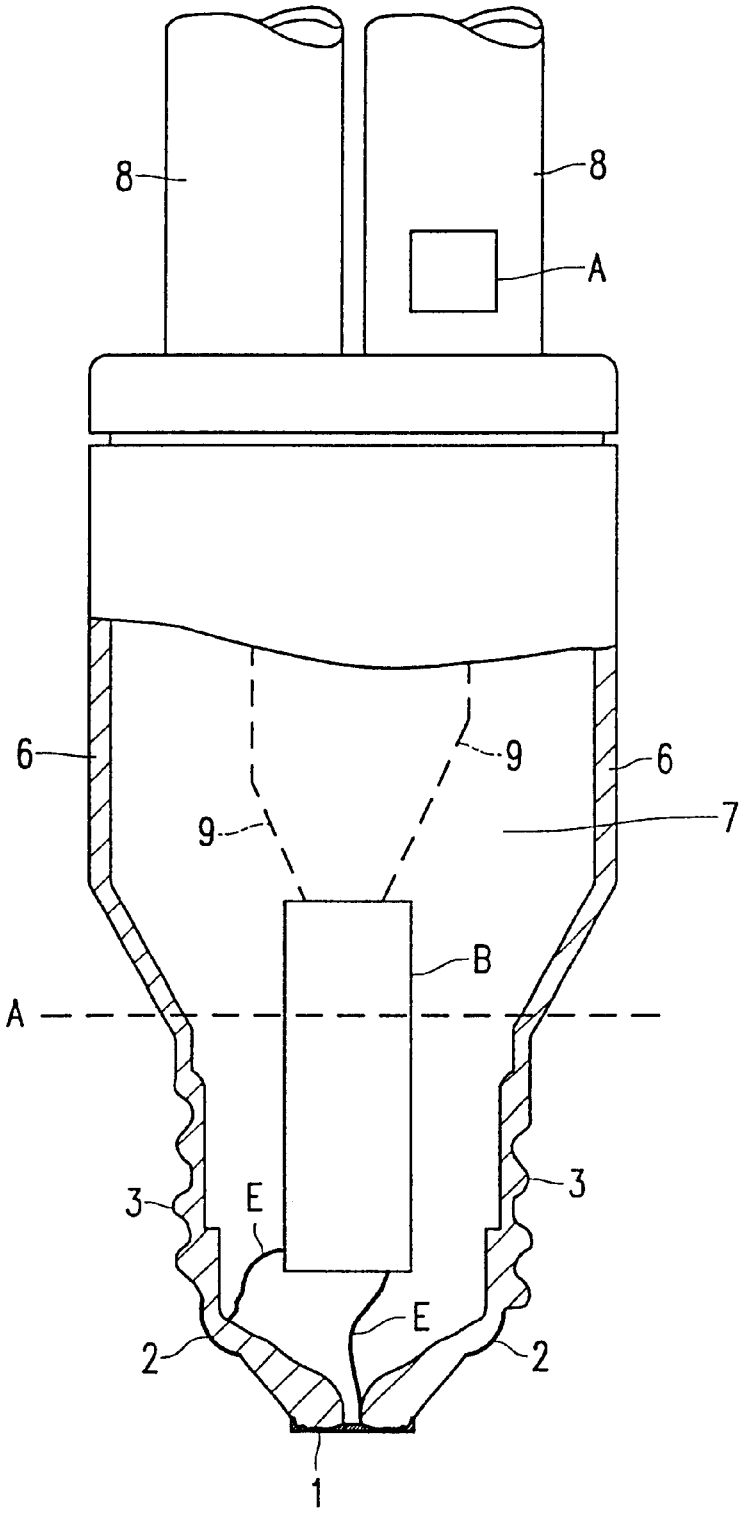
FIG. 4 shows a schematic representation of a compact fluorescent lamp with an integrated circuit arrangement as shown in FIG. 1.

In FIG. 4, a light source 8 is provided with a (discharge) vessel which is closed in a gastight manner, is transmissive for radiation and comprises two electrodes, an anode and a cathode (not shown). It is remarked that the anode can be of a particular simple construction since it does not need to emit electrons. The light source contains a filling consisting of a mixture of noble gases. An amalgam C is present in the light source in the vicinity of the anode. A housing 6 is connected to the light source and provided with a lamp cap 3, in this embodiment that part of the housing that is below the broken line A. This housing may be formed, for example, from a synthetic resin. B is a circuit arrangement as shown in FIG. 1. Circuit arrangement B is electrically connected to the light source. This connection is indicated with broken lines 9 in FIG. 4. The circuit arrangement B is placed in a space 7 which is surrounded by the housing 6. E forms current conducting connections between the circuit arrangement B and metal contacts 1 and 2 placed on the lamp cap. A supply voltage is present between said contacts during lamp operation.

During lamp operation a DC current flows through the light source, which results in a migration of mercury ions in the direction of the cathode of the light source. This process is known as cataphoresis and can result in a strong decrease in the light output of the light source because of the absence of mercury in a large part of the discharge vessel. In the compact lamp shown in FIG. 4, however, the migration of mercury ions towards the cathode by means of cataphoresis is compensated by the transport of mercury atoms caused by the amalgam in the vicinity of the anode. It has been found that the light output of the light source remained at a constant level, irrespective of the time during which the lamp was kept in operation.

What is claimed is:

1. A circuit arrangement for supplying a discharge lamp with a DC lamp current comprising only passive components, said circuit comprising:

input terminals for connection to a low frequency AC supply voltage source, rectifying means having two input terminals coupled to the input terminals, and two output terminals, for generating a DC voltage from the low frequency AC voltage supplied by said supply voltage source, capacitive ballast means coupled between the input terminals and the output terminals of the rectifying means, and a load circuit coupled to the output terminals of the rectifying means and comprising inductive means and terminals for connection to the lamp, wherein the inductive means and lamp connection terminals form a series arrangement connecting the output terminals of the rectifying means, and the load circuit is devoid of a filter capacitor, wherein the rectifying means comprise a voltage doubler, and the capacitive means comprises two capacitors included in the voltage doubler.

2. The circuit arrangement according to claim 1, wherein the impedance of the capacitive means is higher than the impedance of the inductive means.

3. The circuit arrangement according to claim 1, wherein, during stable operation of the discharge lamp, there are time periods during the alternating AC supply voltage that the rectifying means do not supply a current to the load circuit, and the inductive means is dimensioned so that, during said timer periods, the flow of DC lamp current is continuous.

4. The circuit arrangement according to claim 1, wherein the rectifying means comprise a diode bridge and the capacitive ballast means are coupled between one input terminal of said supply voltage input terminals and an input terminal of the diode bridge.

5. A circuit arrangement for supplying a discharge lamp with a DC lamp current comprising only passive components, said circuit comprising:

input terminals for connection to a low frequency AC supply voltage source, rectifying means having two input terminals coupled to the input terminals, and two output terminals, for generating a DC voltage from the low frequency AC voltage supplied by said supply voltage source, capacitive ballast means coupled between the input terminals and the output terminals of the rectifying means, and a load circuit coupled to the output terminals of the rectifying means and comprising inductive means and terminals for connection to the lamp, wherein the inductive means and lamp connection terminals form a series arrangement connecting the output terminals of the rectifying means, and the load circuit is devoid of a filter capacitor, wherein the rectifying means further comprise a diode bridge and a voltage doubler comprising two diodes of the diode bridge and two capacitors.

6. The circuit arrangement according to claim 1, wherein the circuit arrangement consists of the components that make up the capacitive means, the inductive means and the rectifying means.

7. A compact discharge lamp comprising:

a light source provided with a vessel that is closed in a gastight manner and transmissive for visible radiation, a housing connected to the light source and provided with a lamp cap, ballast means electrically connected to the light source for operating the light source and positioned at least partly in a space surrounded by the housing, wherein the ballast means comprises a circuit arrangement for supplying a discharge lamp with a DC lamp current comprising only passive components, said circuit comprising:

input terminals for connection to a low frequency AC supply voltage source, rectifying means having two input terminals coupled to the input terminals, and two output terminals, for generating a DC voltage from the low frequency AC voltage supplied by said supply voltage source, capacitive ballast means coupled between the input terminals and the output terminals of the rectifying means, and a load circuit coupled to the output terminals of the rectifying means and comprising inductive means and terminals for connection to the lamp, wherein the inductive means and lamp connection terminals form a series arrangement connecting the output terminals of the rectifying means, and the load circuit is devoid of a filter capacitor.

8. The compact lamp according to claim 7, wherein the inductive means is so dimensioned that, during operation of the lamp, the DC lamp current is continuous.

9. The compact lamp according to claim 7, wherein the light source comprises mercury and an amalgam.

10. The compact lamp according to claim 9, wherein the amalgam contains lead, bismuth and tin.

11. The compact lamp according to claim 9, wherein the amalgam contains bismuth and indium.

12. A circuit for operating a discharge lamp comprising:

input terminals for connection to a low frequency AC source of supply voltage, rectifying means having first and second input terminals coupled to respective input terminals for the AC supply voltage and first and second output terminals for producing a DC voltage from a low frequency AC supply voltage at the input terminals for the AC supply voltage, capacitive means coupled to one of the AC supply voltage input terminals and to at least one terminal of the rectifying means, and a load circuit coupled to the first and second output terminals of the rectifying means and comprising only passive circuit components including inductive means connected in series circuit with first and second connection terminals for connection to a discharge lamp, wherein the capacitive means comprise a first capacitor connected between the one of the AC supply voltage terminals and the first input terminal of the rectifying means, and the rectifying means comprise a diode bridge circuit and second and third capacitors connected in a second series circuit to the first and second output terminals of the rectifying means and with a junction therebetween connect to the first input terminal of the rectifying means.

13. The discharge lamp operating circuit as claimed in claim 12 further comprising;

a starter device connected across the first and second lamp connection terminals for starting a connected discharge lamp in cooperation with an induced voltage kick produced by said inductive means during start-up of the connected discharge lamp.

14. The discharge lamp operating circuit as claimed in claim 12 wherein the rectifying means comprises only first and second diodes connected in series aiding to the first and second output terminals of the rectifying means and with a junction therebetween connected to the other one of said input terminals for the AC supply voltage, whereby said diodes and said second and third capacitors operate as a voltage-raising apparatus for ignition of a discharge lamp connected to the first and second lamp connection terminals.

15. The discharge lamp operating circuit as claimed in claim 12 wherein the impedance of the capacitive means is higher than the impedance of the inductive means.

16. The discharge lamp operating circuit as claimed in claim 12 wherein the capacitive means and the inductive means are chosen so that during stable lamp operation the capacitive means function as a DC current limiting impedance device and the inductive means function to produce a continuous "keep-alive" current flow through a connected discharge lamp throughout each cycle of the low frequency AC supply voltage.

17. The discharge lamp operating circuit as claimed in claim 12 wherein the discharge lamp is chosen from the group consisting of a high pressure discharge lamp and a low pressure discharge lamp, and a glow switch starter is connected across the lamp first and second connection terminals, wherein the load circuit is devoid of a filter capacitor.

18. The circuit arrangement according to claim 1, wherein the inductive means comprises a choke with a toroid core of compressed iron powder.

19. A circuit for operating a discharge lamp comprising:

input terminals for connection to a low frequency AC source of supply voltage, rectifying means having first and second input terminals coupled to respective input terminals for the AC supply voltage and first and second output terminals for producing a DC voltage from a low frequency AC supply voltage at the input terminals for the AC supply voltage, capacitive means coupled to one of the AC supply voltage input terminals and to at least one terminal of the rectifying means, and a load circuit coupled to the first and second output terminals of the rectifying means and comprising only passive circuit components including inductive means connected in series circuit with first and second connection terminals for connection to a discharge lamp, wherein the load circuit is devoid of any capacitive element, wherein, during stable operation of a connected discharge lamp, the rectifying means supplies the load circuit with a lamp current that is the sum of a DC current and a unidirectional low frequency alternating current.

20. The discharge lamp operating circuit as claimed in claim 19 wherein the amplitude of the unidirectional low frequency alternating current is greater than that of the DC current.

21. The discharge lamp operating circuit as claimed in claim 12 wherein the inductive means is dimensioned so that, during stable operation of the lamp, the DC lamp current is continuous.

22. The discharge lamp operating circuit as claimed in claim 12 wherein the capacitive means comprise first and second capacitors coupled to the rectifying means so as to form a voltage doubler.

* * * * *